US005845774A

United States Patent [19]

Hausknecht

[11] Patent Number: 5,845,774

[45] Date of Patent: Dec. 8, 1998

[54] SCREW GAUGE AND INDEXED DRILL HOLDER

[76] Inventor: Stephen E. Hausknecht, 2158 Terra Linda Dr., Salt Lake City, Utah 84124

[21] Appl. No.: 829,355

[22] Filed: Mar. 31, 1997

[51] Int. Cl.[6] ..... B65D 85/28

[52] U.S. Cl. ..... 206/379; 211/69

[58] Field of Search ..... 206/372, 373, 206/379; 211/69; 33/199

[56] References Cited

U.S. PATENT DOCUMENTS

| | | | |
|---|---|---|---|
| 811,414 | 1/1906 | La Francis . | |
| 1,025,255 | 5/1912 | Driver . | |
| 1,246,536 | 11/1917 | Bristol . | |
| 1,396,509 | 11/1921 | Faltermayer . | |
| 2,728,145 | 12/1955 | Holladay | 33/199 R |
| 2,830,380 | 4/1958 | Rumonoski | 33/199 |
| 2,928,181 | 3/1960 | Siemantel | 33/178 |
| 4,032,008 | 6/1977 | Vecchiarelli | 206/379 |
| 5,048,700 | 9/1991 | Feder | 211/70.6 |

*Primary Examiner*—David T. Fidei
*Attorney, Agent, or Firm*—Mallinckrodt & Mallinckrodt

[57] ABSTRACT

A screw gauge and indexed drill holder for use with sheet metal or wood screws has a base with a series of progressively smaller gauging holes into which a user can insert a screw of unknown gauge, the gauge of which is determined by the smallest hole into which the screw will fit. A series of holes sized to accept and hold body (clearance) drills of specific sizes is coordinated with the gauging holes such that once the gauge of a screw is determined, the proper body drill is referenced and immediately available. Another set of holes sized to accept and hold pilot drills of specific sizes may also be present and coordinated with the gauging holes to indicate and provide the proper pilot drill for a screw of a particular gauge. Indicia may be provided which shows the screw gauge corresponding to a particular gauging hole, the screw body diameter, the corresponding body drill size, and the corresponding pilot drill size. A set of drills may be provided with the device.

30 Claims, 2 Drawing Sheets

SCREW GAUGE AND INDEXED DRILL HOLDER

BACKGROUND OF THE INVENTION

1. Field

The present invention is directed to a device for gauging screws, and referencing the appropriate drills for the screw.

2. State of the Art

The use of screws is a common method of securing one item to another item or of securing component parts of an item together. With wood screws used to secure an item to a wood or similar material, a pilot hole, smaller in diameter than the screw, is drilled into the item to which the screw is to be secured with the screw compressing the wood and forming its own mating threads in the wood as it is screwed into the wood. If the pilot hole is too large, the screw will not compress the wood sufficiently to securely hold it in the wood. The screw can easily be pulled from the hole stripping the threads. If the pilot hole is too small, it can be extremely difficult to screw the screw into the wood because excessive compression of the wood is necessary to make room for the screw. Sometimes the screw will fit so tightly that the head will break off during screwing and the screw becomes worthless. Another hole and screw is then necessary to hold the item. Thus, it is preferable to use a pilot hole that is properly sized for the particular size of screw being used.

Where a screw is to freely pass through a hole, such as freely pass through a first item that is being secured to a second item, a body hole sized to freely pass the screw is drilled through the first item. Here again, if the body hole is too small, the screw will not pass freely through it. If the body hole is too large, the item will not be held securely, but can be moved as the screw moves within the hole. Thus, it is preferable to use a body hole that is properly sized for the particular size of screw being used.

Sheet metal screws, which are also self-taping, also require similarly properly sized pilot and body holes.

The pilot and body holes are usually drilled by a person joining the items. The drills used are selected by such person. Typically, a person must refer to a chart to determine what size pilot and body drills to use for a particular screw size or resort to guessing. The use of the chart presupposes that the person selecting the drills knows the size of the screw. If the screw is one selected from an assortment of different size screws stored together by the person, a screw gauge is necessary to measure the size of the screw selected before the chart can be used.

U.S. Pat. No. 811,414 teaches a combination drill holder and drill gauge for machine screws. The device has a top plate with non-threaded holes corresponding to various drill sizes which plate functions as a drill gauge and holder therefor. A second parallel plate with corresponding holes and a third parallel plate having no holes functions to retain the drills along with the first plate. A front plate has indicia in the form of a chart referencing the machine screw number, threads per inch, tap drill size, and body drill size. The top plate has indicia indicating what size drill goes into each particular hole. There is, however, no screw gauge incorporated into this device.

U.S. Pat. No. 1,246,536 teaches a combination machine screw, drill, and tap holder which has two metal parallel plates, the top plate having a series of non-threaded holes arranged in groups such that a first hole is sized to hold a sample machine screw against which an unknown screw can be compared. A second hole in the series holds a tap drill, a third hole holds a body drill, and a fourth hole holds a tap. Various indicia adjacent the holes indicate the screw number, threads per inch, tap drill, and bore drill sizes. The holes are arranged so that once a screw is identified by comparison with the sample screws, the correct tap drill, body drill, and tap are indicated and available for use. However, the holes in which the sample screws are stored are not intended to be used to determine the gauge of the machine screws.

It should be noted that a tap drill for a machine screw makes a hole slightly smaller than the screw so that threads corresponding to threads in the screw can be cut into the hole by the tap. Since the metal or other hard material into which the hole to be tapped is drilled is substantially noncompressible, the threads cut are strong to hold the screw securely in the material. Generally, a tap drill will be larger than the appropriate pilot drill for a wood screw so the indication of a tap drill does not correspond to or indicate the appropriate drill size to drill a pilot hole for a wood screw.

U.S. Pat. No. 4,032,008 teaches a drill and tap holder for machine screws which has a top plate with two parallel rows of holes of graduated size, the first row for holding taps and the second row for holding tap and body drills. Indicia in the form of a series of convergent lines denote what size tap drill and what size body drill to use for a given tap such that most of the drills serve dual functions both as tap and body drills. Indicia indicate the tap sizes and the drill sizes. However, there is no provision for gauging the screws.

U.S. Pat. No. 2,928,181 teaches an elongated wood screw gauge which has a series of holes along its length for wood screws. Indicia on various faces of the gauge adjacent the respective holes denote the screw number, pilot drill size, and body drill size. However, the drills themselves are not held by the device and are therefore not immediately available to the user. The user has to pick out the indicated drills of proper size from a separate supply of drills.

SUMMARY OF THE INVENTION

The invention is a screw gauge and indexed drill holder for determining the gauge of a screw, referencing the appropriate pilot and body drills for use with the particular screw, and for holding such drills so that they are immediately and easily accessible once the screw gauge is indicated. The device has a base having a series of graduated gauging holes into which a user can insert a screw to determine its gauge. A series of holes to accept and hold drills of specific sizes are positioned to coordinate with the gauging holes. The user takes the screw to be gauged and positions it into the smallest gauging hole into which the screw will fit. The user can then remove the corresponding indicated body drill which is sized for the body hole to be made for the screw or can remove the corresponding indicated pilot drill which is sized for the pilot hole to be made for the screw. Visual indications of screw size, body drill size, pilot drill size, and various other indications may be provided, but are not necessary. If desired, only the body drills or only the pilot drills may be provided.

The device may be used while lying on a table or other flat surface, while held in hand, or legs may be added to the base to raise the base off of a supporting surface so as to allow particularly long screws to be completely inserted into the gauging holes and project through the base for proper screw gauging. The device can be sold with or without the drills. If sold without drills, the user would add the appropriately sized drills obtained from other sources.

THE DRAWINGS

The best mode presently contemplated for carrying out the invention is illustrated in the accompanying drawings, in which:

FIG. 1 is a perspective view of the device of the invention;

FIG. 2, a transverse vertical section along the line 2—2 of FIG. 1;

FIG. 3, an end elevational view of an embodiment of the invention having legs; and FIG. 4, a perspective view of an embodiment with legs showing a set of drills positioned therein.

DETAILED DESCRIPTION OF THE ILLUSTRATED EMBODIMENTS

Figure 1:
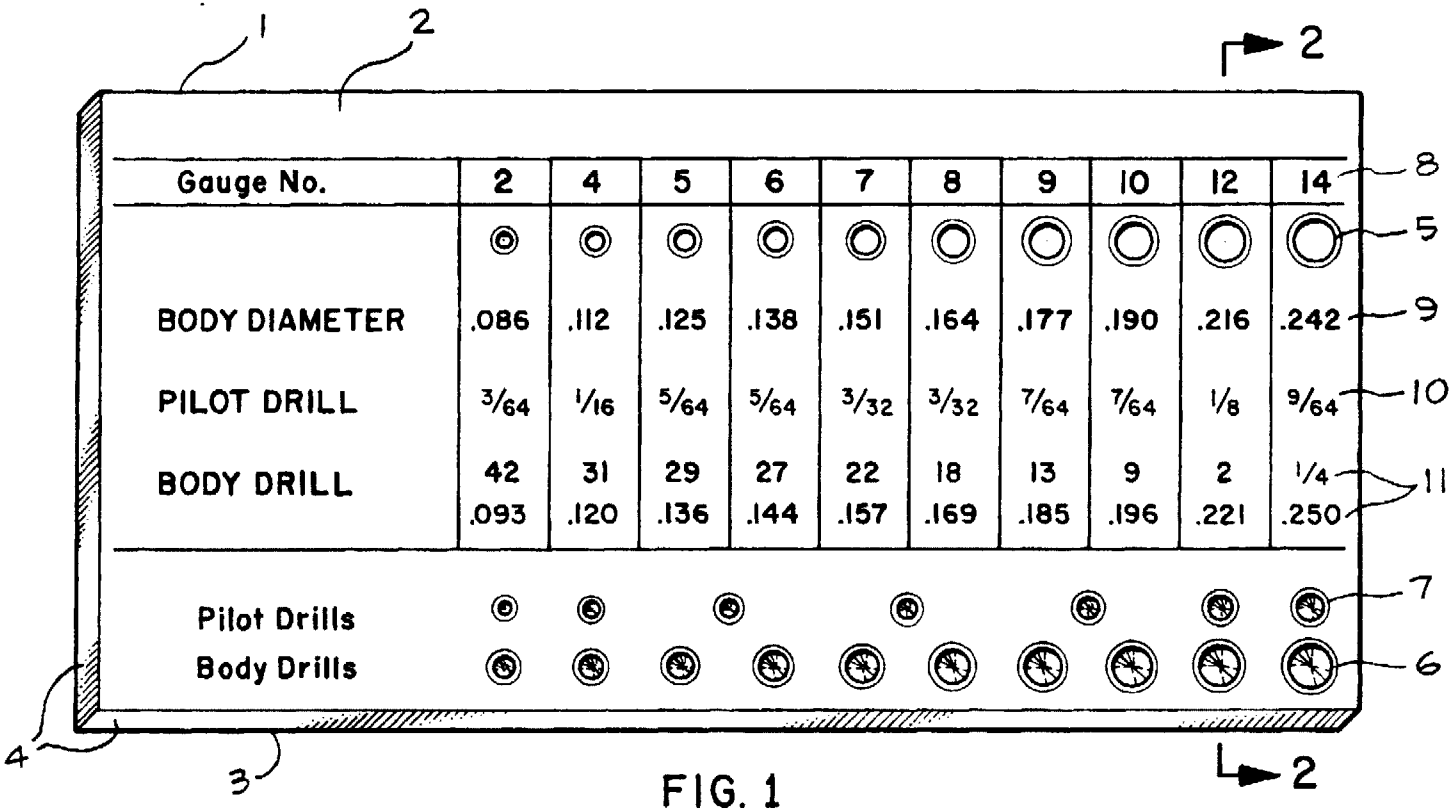

Referring to FIG. 1, there is shown a preferred embodiment of the invention having a solid generally rectangular base 1 preferably about ½ inch thick. The base 1 is made from a plastic (e.g. "Plexiglas"), wood, metal, or other machinable or moldable material. Base 1 has a top face 2, a bottom face 3, and four side faces 4.

A series of gauging holes 5 extend completely through base 1 from top face 2 to bottom face 3 and are sized to closely accept common sheet metal or wood screw sizes. The gauging holes 5 are preferably arranged in order of size such that a screw of unknown gauge can be inserted into progressively smaller gauging holes 5 until the smallest hole into which the screw fits is found. Alternately, the screw could be tried in progressively larger gauging holes until similarly, the smallest hole into which the screw fits is found.

A series of body drill holes 6 extend from top face 2 partially through the base 1 and are of the same size as the gauging holes 5 so as to accept and hold a set of body drills corresponding to the gauging holes 5. The body drill holes 6 are coordinated with the gauging holes 5 such that after the gauge of a screw is determined using gauging holes 5, the user can take the corresponding body drill from the appropriate body drill hole 6 to use in drilling a body hole and then return the drill to the same body drill hole 6 for storage until next use. Generally the body drill holes 6 will be coordinated with the gauging holes 5 by directly aligning the body drill hole 6 with its corresponding gauging hole 5.

A series of pilot drill holes 7 may be provided, which extend from top face 2 partially through the base 1 and are sized to accept and hold a set of pilot drills of specific sizes, the pilot drill holes 7 being coordinated with the gauging holes 5 as were the body drill holes 6 such that after the gauge of a screw is determined using gauging holes 5, the user can take the corresponding pilot drill from the appropriate pilot drill hole 7 to use in drilling a pilot hole and then return the drill to the same pilot drill hole 7 for storage until next use. Generally, because the material with which wood screws are used is somewhat compressible, the size of the pilot drills are not critical and can vary somewhat for the same gauge screw. The important thing is that the pilot holes be small enough to so that the particular gauge screw is securely held in the wood or other material into which it is screwed. Because of this some screws of differing gauges may use the same pilot drill such as wood screws gauge five and gauge six, gauge seven and gauge eight, and gauge nine and gauge ten. This economizes of the number of pilot drills needed. Where screws are being used in hard wood or other hard materials, such as oak, it may be possible to use the next larger size pilot drill to more easily screw the screw into the material yet still have it hold securely. Where a pilot drill corresponds to a single gauging hole 5, such as for gauges two, four, twelve, or fourteen in FIG. 1, the pilot drill holes 7 will be coordinated with the respective gauging holes 5 by directly aligning such pilot drill holes 7 with both the corresponding gauging holes 5 and body drill holes 6. Where a single pilot drill corresponds to two gauging holes 5, such as for gauges five and six, seven and eight, or nine and ten, as shown in FIG. 1, the pilot drill holes 7 will be coordinated with the holes 5 by being positioned between the corresponding gauging holes 5, as shown. This also positions the pilot drill holes 7 between the body drill holes 6 which correspond to such gauging holes.

Various visual or other indicia may be provided for the user and associated with gauging holes or drill holding holes on the top face 2. These indicia may be provided by using a label, silk screening, hot stamping, molding, or other widely used processes for plastics, metals, and the like. Such indicia may include gauge number indicia 8, body diameter indicia 9, pilot drill size indicia 10, and body drill size indicia 11.

Figure 2:
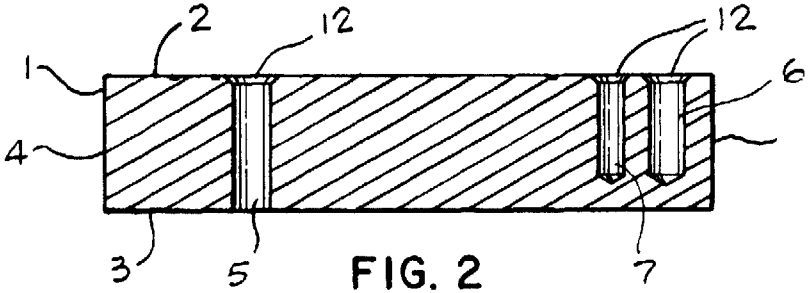

As best can be seen in FIG. 2, the gauging holes 5 extend completely through base 1 from top face 2 to bottom face 3 to allow longer screws to extend completely through holes 5 to allow for a more accurate gauging of longer screws. Body drill holes 6 and pilot drill holes 7 do not extend completely through base 1, but rather terminate about 1/16 inch from the bottom face 3 so as to support the drills in their respective holes. Each of gauging holes 5, body drill holes 6, and pilot drill holes 7 may have a chamfer 12 at top face 2 to aid in the insertion of screws and drills, respectively. All three of these holes may be made in base 1 by injection molding them integrally with base 1, by drilling, or by other process.

The screw gauging holes 5 and body drill holes 6 are preferably slightly larger than the exact size for the gauge number indicated. This is because wood and sheet metal screws, as opposed to machine screws that must fit into mating threaded holes, have a relatively large manufacturing tolerance. Thus, wood or sheet metal screws of an indicated gauge may vary in size by up to about seven thousandths of an inch. The gauging holes should be large enough to accept the largest screws of the indicated number.

The embodiment of the invention shown in FIGS. 1 and 2, wherein base 1 is relatively thick, can be used with bottom face 3 resting on a table top or other relatively flat surface. An alternative to this, particularly when gauging longer screws which extend out past bottom face 3, is to hold the device in hand. This method allows the screw to slide all the way into the gauging hole 5 for a better measure of the screw gauge.

Figure 3:
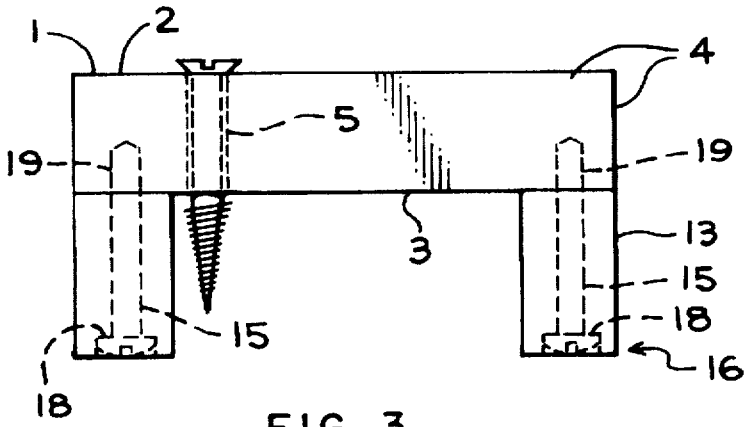

FIG. 3 shows an embodiment of the invention wherein the body 1 has four round legs 13 attached to bottom face 3, one adjacent each corner of base 1. The purpose of the legs is to elevate base 1 relative to a supporting surface to allow longer screws to extend through the gauging holes 5. A flat head wood screw, for example, is shown inserted in a gauging hole 5. The screw is not a part of this invention and is furnished by the user. The legs 13 can be removably attached to base 1 by conventional means such as by using four leg screws 14, one being disposed in a longitudinal leg hole 15 of each leg 13, the leg hole for most of its length being slightly larger diameter than the leg screw 14, but having a larger diameter at a distal end 16 to accommodate screw head 17 and forming an annular shoulder 18. Each leg screw 14 is threaded into one of four threaded holes 19 in base 1 adjacent the intersection of each set of side faces 4. Each leg screw 14 is torqued with the screw head drawn tight against an annular shoulder 18 to secure each leg 13. Legs 13 may alternatively be permanently affixed to bottom face 3 such as by gluing or molding them integrally with base 1.

Figure 4:
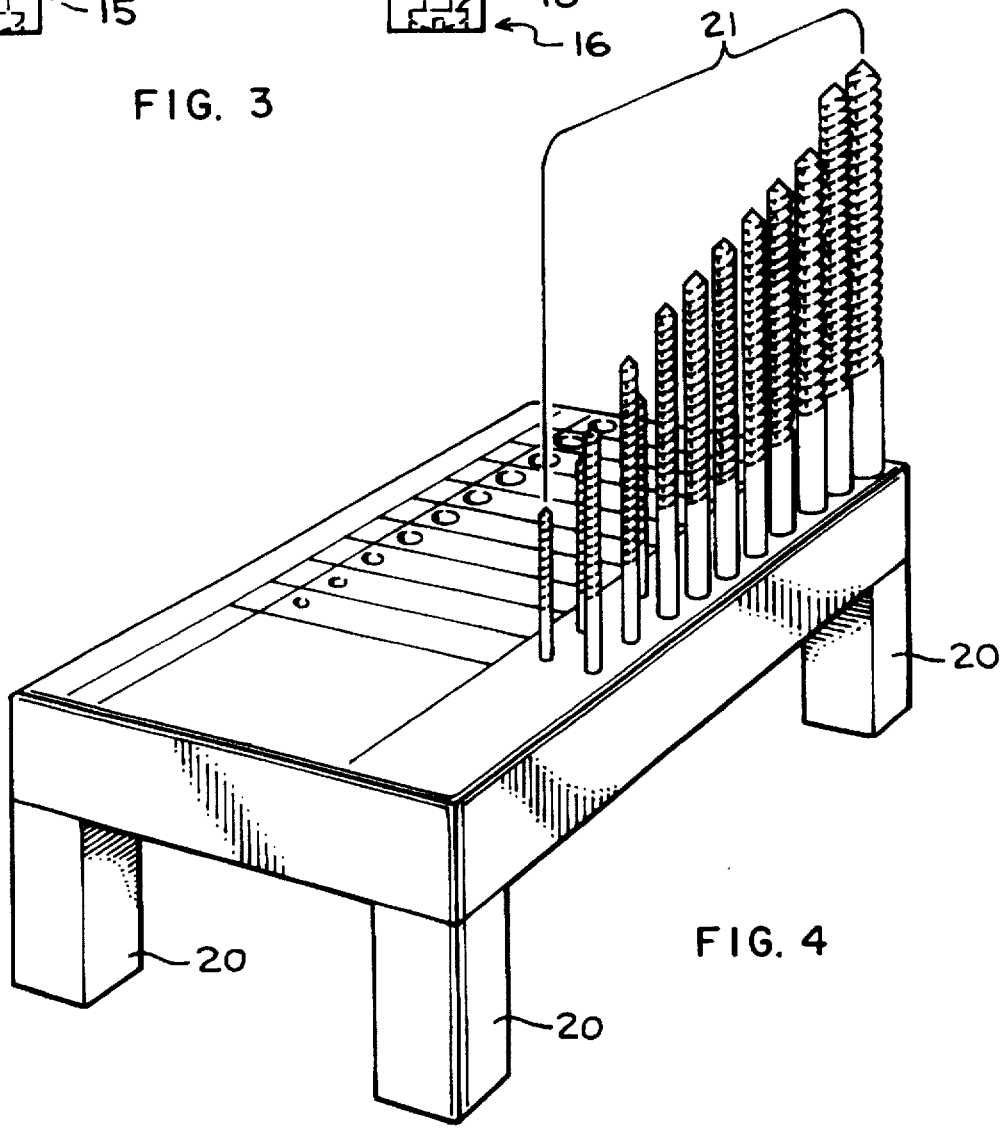

FIG. 4 shows an embodiment having square legs 20 which can be conventionally fastened as stated previously. This embodiment includes a set of body and pilot drills 21 as part of the invention. Any of the stated embodiments can be supplied without drills or have a set of drills included.

With an embodiment supported above a surface such as shown in FIGS. 3 and 4, the base 1 can be relatively thin, the thickness of the base being just enough so that body drill holes 6 and pilot drill holes 7 are deep enough to hold the body and pilot drills therein.

While the base 10 has been shown and described as solid, the base does not have to be solid and could be molded or otherwise constructed in various configurations. Further, while the device has been described for use specifically with wood or sheet metal screws, it can be used to determine the gauge of machine screws and to determine the body drill for the machine screws. However, the indicated pilot drill generally cannot be used with a machine screw because the pilot drill is usually smaller than a tap drill.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

It is claimed:

1. A screw gauge and indexed drill holder for determining the gauge of sheet metal or wood screws and for holding drills of specific sizes, comprising a generally solid base; a plurality of gauging holes of varying diameter which extend completely through the base for receiving and determining the gauge of a screw inserted therein; and a plurality of body drill holes which do not extend completely through the base for receiving and holding drills, the body drill holes being positioned to coordinate with the gauging holes such that a drill of proper size to drill a body hole is indicated for each gauging hole whereby when the smallest gauging hole into which a screw can be fit is determined, the corresponding drill is indicated and can be removed from the body drill hole to drill a hole sized to closely pass the body of that gauge screw.

2. A screw gauge and indexed drill holder as in claim 1, further including a plurality of pilot drill holes which do not extend completely through the base for receiving and holding drills, the pilot drill holes being positioned to coordinate with the gauging holes such that a drill of proper size to drill a pilot hole is indicated for each gauging hole whereby when the appropriate gauging hole is determined for a screw, the corresponding drill can be removed from the pilot drill hole to drill a hole sized to pilot the screw.

3. A screw gauge and indexed drill holder as in claim 2, wherein the base has a top face with an indicia thereon of screw size, body drill size, and pilot drill size.

4. A screw gauge and indexed drill holder as in claim 2, wherein the base is a solid rectangular block and the gauging holes are about 0.007 inch larger than the nominal screw diameter.

5. A screw gauge and indexed drill holder as in claim 4, wherein:

a) the gauging holes and the corresponding body drill holes are the same size;

b) the gauging holes are chamfered; and c) the body drill holes extend to within about 1/16 inch of extending completely through the base and are chamfered.

6. A screw gauge and indexed drill holder as in claim 5, further including a plurality of legs attached to the base to elevate the base relative to a supporting surface so as to allow longer length screws to extend completely through and protrude beneath the base without contacting the supporting surface.

7. A screw gauge and indexed drill holder as in claim 1, wherein the base has a top face with an indicia thereon of screw size and body drill size.

8. A screw gauge and indexed drill holder as in claim 1, wherein the base is a solid rectangular block and the gauging holes are about 0.007 inch larger than the nominal screw diameter.

9. A screw gauge and indexed drill holder as in claim 8, wherein:

a) the gauging holes and the corresponding body drill holes are the same size;

b) the gauging holes are chamfered; and c) the body drill holes and the pilot drill holes extend to within about 1/16 inch of extending completely through the base and are chamfered.

10. A screw gauge and indexed drill holder as in claim 9, further including a plurality of legs attached to the base to elevate the base relative to a supporting surface so as to allow longer length screws to extend completely through and protrude beneath the base without contacting the supporting surface.

11. A combination of a screw gauge and indexed drill holder with drills of specific sizes, for determining the gauge of sheet metal or wood screws and for holding the drills, comprising:

a) a plurality of drills;

b) a generally solid base having a plurality of gauging holes of varying diameter which extend completely through the base for receiving and determining the gauge of a screw inserted therein, and a plurality of body drill holes which do not extend completely through the base for receiving and holding the drills, the body drill holes being positioned to coordinate with the gauging holes such that when the smallest gauging hole into which a screw can be fit is determined, the corresponding drill is indicated and can be removed from the body drill hole to drill a hole sized to closely pass the body of that gauge screw.

12. A combination of a screw gauge and indexed drill holder with drills of specific sizes as in claim 11, the base further having a plurality of pilot drill holes which do not extend completely through the base for receiving and holding drills, the pilot drill holes being positioned to coordinate with the gauging holes such that when the appropriate gauging hole is determined, the corresponding drill can be removed from the pilot drill hole to drill a hole sized to pilot the screw.

13. A combination of a screw gauge and indexed drill holder with drills of specific sizes as in claim 12, wherein the base has a top face with an indicia thereon of screw size, body drill size, and pilot drill size.

14. A combination of a screw gauge and indexed drill holder with drills of specific sizes as in claim 12, wherein the base is a solid rectangular block and the gauging holes are about 0.007 inch larger than the nominal screw diameter.

15. A combination of a screw gauge and indexed drill holder with drills of specific sizes as in claim 14, wherein:

a) the gauging holes and the corresponding body drill holes are the same size;

b) the gauging holes are chamfered; and c) the body drill holes extend to within about 1/16 inch of extending completely through the base and are chamfered.

16. A combination of a screw gauge and indexed drill holder with drills of specific sizes as in claim 15, further including a plurality of legs attached to the base to elevate the base relative to a supporting surface so as to allow longer length screws to extend completely through and protrude beneath the base without contacting the supporting surface.

17. A combination of a screw gauge and indexed drill holder with drills of specific sizes as in claim 11, wherein the base has a top face with an indicia thereon of screw size and body drill size.

18. A combination of a screw gauge and indexed drill holder with drills of specific sizes as in claim 11, wherein the base is a solid rectangular block and the gauging holes are about 0.007 inch larger than the nominal screw diameter.

19. A combination of a screw gauge and indexed drill holder with drills of specific sizes as in claim 18, wherein:

a) the gauging holes and the corresponding body drill holes are the same size;

b) the gauging holes are chamfered; and c) the body drill holes and the pilot drill holes extend to within about 1/16 inch of extending completely through the base and are chamfered.

20. A combination of a screw gauge and indexed drill holder with drills of specific sizes as in claim 19, further including a plurality of legs attached to the base to elevate the base relative to a supporting surface so as to allow longer length screws to extend completely through and protrude beneath the base without contacting the supporting surface.

21. A screw gauge and indexed drill holder for determining the gauge of sheet metal or wood screws and for holding drills of specific sizes, comprising a solid rectangular block base having a top face with an indicia thereon of screw size, body drill size, and pilot drill size; a plurality of chamfered gauging holes of varying diameters which extend completely through said base for receiving and determining the gauge of a screw inserted therein, said gauging holes being about 0.007 inch larger than the nominal screw diameter; a plurality of chamfered body drill holes, which extend to within about 1/16 inch of extending completely through the base, for receiving and holding drills, each of said body drill holes being of the same size as the corresponding gauging hole; and a plurality of pilot drill holes in the base for receiving and holding drills, the body drill holes and the pilot drill holes positioned to coordinate with the gauging holes such that a drill of proper size to drill a body hole and a drill of proper size to drill a pilot hole are indicated for each gauging hole whereby when the smallest gauging hole into which a screw can be fit is determined, the corresponding body drill and pilot drill are indicated and can be removed from the body drill hole and the pilot drill hole, respectively, to drill a hole sized to closely pass the body of that gauge screw, and to drill a hole sized to pilot that gauge screw, respectively.

22. A screw gauge and indexed drill holder as in claim 21, further including a plurality of legs attached to the base to elevate the base relative to a supporting surface so as to allow longer length screws to extend completely through and protrude beneath the base without contacting the supporting surface.

23. A screw gauge and indexed drill holder for determining the gauge of sheet metal or wood screws and for holding drills of specific sizes, comprising a solid rectangular block base having a top face with an indicia thereon of screw size and body drill size; a plurality of chamfered gauging holes of varying diameters which extend completely through said base for receiving and determining the gauge of a screw inserted therein, said gauging holes being about 0.007 inch larger than the nominal screw diameter; and a plurality of chamfered body drill holes, which extend to within about 1/16 inch of extending completely through the base, for receiving and holding drills, each of said body drill holes being of the same size as the corresponding gauging hole, the body drill holes positioned to coordinate with the gauging holes such that a drill of proper size to drill a body hole is indicated for each gauging hole whereby when the smallest gauging hole into which a screw can be fit is determined, the corresponding drill is indicated and can be removed from the body drill hole to drill a hole sized to closely pass the body of that gauge screw.

24. A screw gauge and indexed drill holder as in claim 23, further including a plurality of legs attached to the base to elevate the base relative to a supporting surface so as to allow longer length screws to extend completely through and protrude beneath the base without contacting the supporting surface.

25. A combination of a screw gauge and indexed drill holder with drills of specific sizes, for determining the gauge of sheet metal or wood screws and for holding the drills, comprising:

a) a plurality of drills;

b) a solid rectangular block base having a top face with an indicia thereon of screw size, body drill size, and pilot drill size, and having a plurality of chamfered gauging holes of varying diameters which extend completely through said base for receiving and determining the gauge of a screw inserted therein, said gauging holes being about 0.007 inch larger than the nominal screw diameter; a plurality of chamfered body drill holes, which extend to within about 1/16 inch of extending completely through the base, for receiving and holding the drills, each of said body drill holes being of the same size as the corresponding gauging hole; and a plurality of pilot drill holes in the base for receiving and holding drills, the body drill holes and the pilot drill holes positioned to coordinate with the gauging holes such that a drill of proper size to drill a body hole and a drill of proper size to drill a pilot hole are indicated for each gauging hole whereby when the smallest gauging hole into which a screw can be fit is determined, the corresponding body drill and pilot drill are indicated and can be removed from the body drill hole and the pilot drill hole, respectively, to drill a hole sized to closely pass the body of that gauge screw, and to drill a hole sized to pilot that gauge screw, respectively.

26. A combination of a screw gauge and indexed drill holder with drills of specific sizes as in claim 25, further including a plurality of legs attached to the base to elevate the base relative to a supporting surface so as to allow longer length screws to extend completely through and protrude beneath the base without contacting the supporting surface.

27. A combination of a screw gauge and indexed drill holder with drills of specific sizes, for determining the gauge of sheet metal or wood screws and for holding the drills, comprising:

a) a plurality of drills;

b) a solid rectangular block base having a top face with an indicia thereon of screw size and body drill size, and having a plurality of chamfered gauging holes of varying diameters which extend completely through said base for receiving and determining the gauge of a screw inserted therein, said gauging holes being about 0.007 inch larger than the nominal screw diameter; and a plurality of chamfered body drill holes, which extend to within about 1/16 inch of extending completely through the base, for receiving and holding the drills, each of said body drill holes being of the same size as the corresponding gauging hole, the body drill holes positioned to coordinate with the gauging holes such that when the smallest gauging hole into which a screw can be fit is determined, the corresponding drill is indicated and can be removed from the body drill hole to drill a hole sized to closely pass the body of that gauge screw.

28. A combination of a screw gauge and indexed drill holder with drills of specific sizes as in claim 27, further including a plurality of legs attached to the base to elevate the base relative to a supporting surface so as to allow longer length screws to extend completely through and protrude beneath the base without contacting the supporting surface.

29. A screw gauge and indexed drill holder for determining the gauge of sheet metal or wood screws and for holding drills of specific sizes, comprising a solid rectangular base; a plurality of gauging holes of varying diameters which extend completely through said base for receiving and determining the gauge of a screw inserted therein; and a plurality of body drill holes which do not extend completely through the base, for receiving and holding drills, each of said body drill holes being of about the same size as the corresponding gauging hole, the body drill holes positioned to coordinate with the gauging holes such that a drill of proper size to drill a body hole is indicated for each gauging hole whereby when the smallest gauging hole into which a screw can be fit is determined, the corresponding drill is indicated and can be removed from the body drill hole to drill a hole sized to closely pass the body of that gauge screw.

30. A screw gauge and indexed drill holder as in claim 29, further including a plurality of pilot drill holes which do not extend completely through the base, for receiving and holding drills, the pilot drill holes positioned to coordinate with the gauging holes such that a drill of proper size to drill a pilot hole is indicated for each gauging hole whereby when the appropriate gauging hole is determined for a screw, the corresponding drill can be removed from the pilot drill hole to drill a hole sized to pilot that gauge screw.

* * * * *